US009097093B1

(12) United States Patent
Frost

(10) Patent No.: US 9,097,093 B1
(45) **Date of Patent: *Aug. 4, 2015**

(54) DOWNHOLE CHEMICAL TREATMENT ASSEMBLY FOR USE IN A DOWNHOLE WELLBORE

(71) Applicant: Cavin B. Frost, Odessa, TX (US)

(72) Inventor: Cavin B. Frost, Odessa, TX (US)

( * ) Notice: Subject to any disclaimer, the term of this patent is extended or adjusted under 35 U.S.C. 154(b) by 219 days.

This patent is subject to a terminal disclaimer.

(21) Appl. No.: 13/949,142

(22) Filed: Jul. 23, 2013

Related U.S. Application Data

(63) Continuation-in-part of application No. 13/686,162, filed on Nov. 27, 2012, now Pat. No. 8,950,491.

(51) Int. Cl.
*E21B 37/06* (2006.01)

(52) U.S. Cl.
CPC ..... *E21B 37/06* (2013.01)

(58) Field of Classification Search
CPC ..... E21B 37/06; E21B 43/02
See application file for complete search history.

(56) References Cited

U.S. PATENT DOCUMENTS

| | | | | |
|---|---|---|---|---|
| 2,437,475 | A | 3/1948 | Oxford, Jr. | |
| 4,032,457 | A | 6/1977 | Matchett | |
| 4,291,763 | A * | 9/1981 | Singer | 166/110 |
| 5,114,540 | A | 5/1992 | Law | |
| 5,893,416 | A | 4/1999 | Read | |
| 7,195,070 | B2 | 3/2007 | Delaloye et al. | |
| 7,406,887 | B2 | 8/2008 | Jensen | |
| 7,413,009 | B2 | 8/2008 | Jacobs et al. | |
| 7,493,955 | B2 | 2/2009 | Gupta et al. | |
| 7,503,389 | B2 | 3/2009 | Delaloye et al. | |
| 7,994,103 | B2 | 8/2011 | Campbell et al. | |
| 2004/0084186 | A1 | 5/2004 | Allison | |
| 2006/0011345 | A1* | 1/2006 | Delaloye et al. | 166/304 |
| 2008/0023703 | A1* | 1/2008 | Hoffman et al. | 257/59 |
| 2011/0162841 | A1 | 7/2011 | Wilson | |
| 2012/0012326 | A1 | 1/2012 | Darby et al. | |

OTHER PUBLICATIONS

Slides from Conoco Phillips—Gas Well Deliquification Worshop, Feb. 19-22, 2012.

Magazine Ad "One Treatment When you Frac. Few Inventions After You Frac." Baker Hughes Incorporated. 36204, Aug. 2012.

T. Smith, S. Szymczak, D.V. Satya Gupta and M. Brown, Solid Paraffin Inhibitor, SPE Paper No. 124868, 2009.

* cited by examiner

*Primary Examiner* — William P Neuder
(74) *Attorney, Agent, or Firm* — Buskop Law Group, PC; Wendy Buskop

(57) ABSTRACT

A downhole assembly for delivering chemical treatment to a wellbore at the level of a hydrocarbon-bearing formation is provided. The chemical treatment is in solid phase, and slowly dissolves when exposed to wellbore fluids.

20 Claims, 6 Drawing Sheets

DOWNHOLE CHEMICAL TREATMENT ASSEMBLY FOR USE IN A DOWNHOLE WELLBORE

CROSS REFERENCE TO RELATED APPLICATIONS

The present application is a continuation-in-part of co-pending U.S. patent application Ser. No. 13/686,162 filed on Nov. 27, 2012, entitled "DOWNHOLE ASSEMBLY FOR TREATING WELLBORE COMPONENTS, AND METHOD FOR TREATING A WELLBORE," which is a non-provisional of U.S. Provisional Patent Application Ser. No. 61/583,752 filed on Jan. 6, 2012, entitled "DOWNHOLE ASSEMBLY FOR TREATING WELLBORE COMPONENTS, AND METHOD FOR TREATING A WELLBORE". These references are incorporated herein in their entirety.

FIELD

The present embodiments generally relate to the field of hydrocarbon recovery operations. The present embodiments further relate to an assembly used for treating a wellbore. The application also relates to apparatus for delivering a chemical treatment to a wellbore below the surface.

BACKGROUND

A need exists for an assembly for providing controlled chemical release into hydrocarbon fluid from a wellbore to prevent buildup of unwanted chemicals on equipment used in oil field operations.

A need exists for an assembly to provide release of chemicals into a hydrocarbon fluid to reduce corrosion on oil field equipment.

A further need exists for an easy to use system with tremendous versatility adaptable to address different chemical compositions of different wellbores.

The present embodiments meet these needs.

BRIEF DESCRIPTION OF THE DRAWINGS

The detailed description will be better understood in conjunction with the accompanying drawings as follows.

Figure 1:
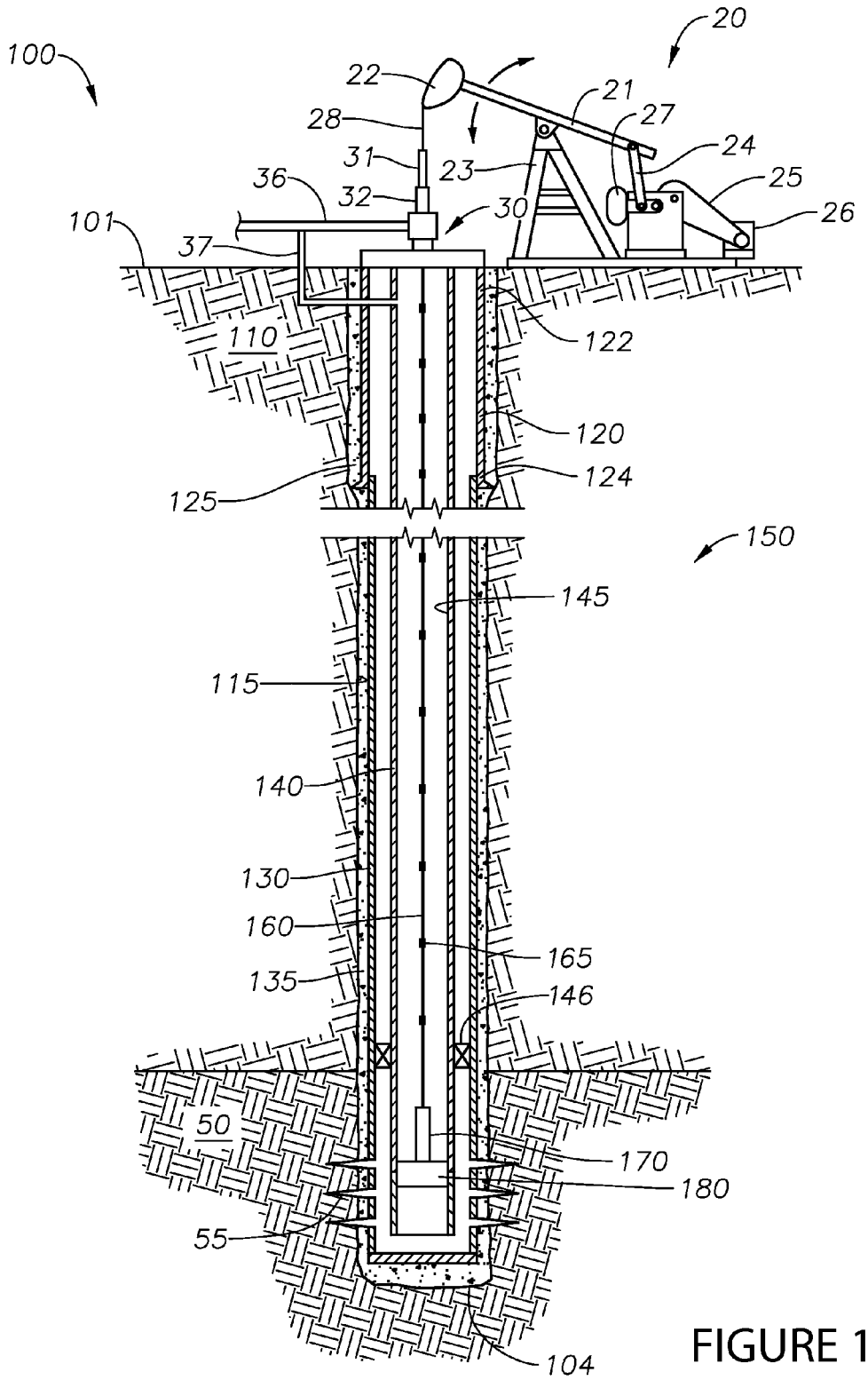
FIG. 1 is a side, cross-sectional view of a well site constructed for hydrocarbon production. The well site includes a wellbore that has a downhole chemical treatment assembly for treating wellbore components according to the invention.

The present embodiments are detailed below with reference to the listed Figures.

TECHNOLOGY IN THE FIELD OF THE INVENTION

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the surrounding formations.

A cementing operation is typically conducted in order to fill or "squeeze" the annular area with columns of cement. The combination of cement and casing strengthens the wellbore and facilitates the zonal isolation of the formations behind the casing.

It is common to place several strings of casing having progressively smaller outer diameters into the wellbore. A first string of casing can be referred to as a conductor pipe or surface casing. This casing string serves to isolate and protect the shallower, fresh water-bearing aquifers from contamination by any other wellbore fluids. Surface casing strings are almost always cemented entirely back to the surface. The process of drilling and then cementing progressively smaller strings of casing is repeated several times until the well has reached total depth. In some instances, the final string of casing is a liner, that is, a string of casing that is not tied back to the surface. The final string of casing, referred to as a production casing, is also typically cemented into place.

Additional tubular bodies can be included in a well completion. These include one or more strings of production tubing placed within the production casing or liner. Each tubing string extends from the surface to a designated depth proximate a production interval, or "pay zone." Each tubing string can have a packer attached at a lower end. The packer serves to seal off the annular space between the production tubing string(s) and the surrounding casing. In this way production fluids are directed up the tubing string.

In some instances, the pay zones are incapable of flowing fluids to the surface efficiently. When this occurs, the operator may include artificial lift equipment as part of the wellbore completion. Artificial lift equipment can include a downhole pump connected to a surface pumping unit via a string of sucker rods run within the tubing. Alternatively, an electrically-driven submersible pump can be placed at the bottom end of the production tubing. Gas lift valves, plunger lift systems, or various other types of artificial lift equipment and techniques can alternatively be employed to assist fluid flow to the surface.

As part of the completion process, a wellhead is installed at the surface. The wellhead includes piping and valves used for directing the flow of production fluids at the surface. The wellhead also contains wellbore pressures.

Fluid gathering and processing equipment is also provided at the surface. Such equipment can include pipes, valves, separators, dehydrators, gas sweetening units, and oil and water stock tanks. Upon installation of the wellhead and other surface equipment, production can begin.

During the production of hydrocarbons from the pay zones, some wells experience a build-up of scale. This may be due to the presence of dissolved minerals in oil and water produced by oil and gas wells. Changes in temperature and/or pressure which occur as production fluids are pumped from the production zone to the surface can cause the inorganic minerals to come out of solution ("precipitate") and become deposited on the interior and exterior surfaces of production hardware. Such hardware can include the production tubing, downhole pumps, surface valves, and other equipment.

Scale is typically in the form of a mineral salt that deposits on the surface of metal or other material. Typical scales are calcium carbonate, calcium sulfate, barium sulfate, strontium sulfate, iron sulfide, iron oxides, iron carbonate, the various silicates and phosphates and oxides, or any of a number of compounds insoluble or slightly soluble in water. The presence of mineral salts can also create corrosion on metal surfaces.

In severe conditions, scale creates a significant restriction, or even a plug, in the production tubing and pump orifices. Scale build-up in an artificial lift pump can lead to failure of the pump due to blocked flow passages and broken shafts. In addition, scale can clog perforations, requiring a well to be treated or even re-perforated.

All waters used in well operations can be potential sources of scale. These include water used in waterflood operations and filtrate from completion, workover or treating fluids. For these and the other reasons mentioned, scale removal is a common well-intervention operation.

A wide range of treatment options are available to effect scale removal. These include mechanical removal, chemical treatment, and corrosion inhibitor treatment.

Mechanical removal can be done by means of a pig that is pumped downhole. Alternatively, mechanical removal can involve abrasive jetting that hydraulically cuts scale but leaves the tubing intact. Of course, such mechanical processes do not protect a submersible pump from scale during production operations, nor do they prevent any future build-up of corrosion.

Scale-inhibition treatments involve squeezing a chemical inhibitor into a water-producing zone for subsequent commingling with produced fluids. The scale inhibitor prevents further scale precipitation along producers. However, such a technique is imprecise as it is unknown how much of the inhibitor will make its way back to the wellbore, or when.

Chemical removal is performed by using different solvents according to the type of scale that is presented. Sulfate scales such as gypsum [$CaSO_42H_2O$] or anhydrite [$CaSO_4$] can be dissolved using ethylene-diamine tetra-acetic acid (EDTA). Carbonate scales such as calcium carbonate or calcite [$CaCO_3$] can be dissolved with hydrochloric acid [HCl] at temperatures less than 250 degrees Fahrenheit (121 degrees Celsius). Silica scales such as crystallized deposits of chalcedony or amorphous opal normally associated with steam flood projects can be dissolved using hydrofluoric acid [HF]. Chloride scales such as sodium chloride [NaCl] can be dissolved using fresh water or weak acidic solutions, including HCl or acetic acid. Iron scales such as iron sulfide [FeS] or iron oxide [$Fe_2O_3$] can usually be dissolved using HCl with sequestering or reducing agents to avoid precipitation of by-products, for example iron hydroxides and elemental sulfur.

In the oil fields of West Texas and other areas where water flooding takes place, calcium sulfate and calcium carbonate scales can appear. Calcium scales, such as calcium sulfate, calcium carbonate and calcium oxalate are insoluble in water. However, all three are soluble in a Sodium Bisulfate acid solution. Calcium scale can be removed with an acid wash using a 5 percent to 15 percent solution of Sodium Bisulfate (SBS). SBS can also be used during a shutdown to remove scale by re-circulating it throughout areas of the process where needed. The concentration of SBS solutions and the re-circulation time depend on the amount of scale that needs to be removed.

Sulfamic acid ($H_3NSO_3$) can also be used in calcium scale (or lime) removal situations. Sulfamic acids include amidosulfonic acid, amidosulfuric acid, aminosulfonic acid, and sulfamidic acid. Sulfuric acids ($H_2SO_4$) can also be considered. Sulfamic acids can slowly hydrolyze to ammonium bisulfate in the presence of water.

The delivery of chemical to a wellbore is normally done by placing the chemical in liquid form into the wellbore. However, it is believed that such chemical delivery is frequently ineffective as it is difficult to assure that the treatment is reaching the lowest portions of the wellbore where it is needed most.

Recently, Baker Hughes, Inc. has developed a SORB™ or SCALESORB™ process for injecting solid pellets and liquid comprising scale inhibitor or other chemical material into a subsurface formation. The inhibitors are typically injected as part of the initial formation fracturing process. The chemicals treat formation fluids before they arrive at the wellbore. Baker Hughes advertises that its SORB™ chemicals inhibit scale, paraffin, asphaltenes, and salt; they counteract bacteria and corrosion. However, this process is a one-time injection that depends on the chemical treatment contacting all fluids produced to the wellbore.

Therefore, a need exists for a downhole assembly that will slowly deliver chemical treatment at the level of production perforations, or at or below the level of a pump. Further, a need exists for an assembly and method for using a continuous solid chemical that directly treats a wellbore as the solid material dissolves in the presence of wellbore fluids.

A benefit of the invention is that solid chemicals are used to treat the wellbore fluids. By using solid materials, liquid does not spill into the land and contaminate the land around the well site.

A benefit of the invention is that it is easy to use, lightweight, and can be used without a lot of training, which enables a well operator to use less above ground equipment, which is known to be a source for leaks.

The assembly when used, works for several months, prevents continuous treatments on a weekly basis by trucks, creating a smaller footprint.

The invention protects the aquifer by providing smaller quantities of chemical and targeted amounts based on specific needs of the well operator, which is a dramatic improvement to the liquid systems currently used.

The embodiments relate to a downhole assembly for delivering chemical treatment to a wellbore.

The tool is recyclable, refurbishable, and refillable, to reduce the carbon footprint of the operator and produce less waste than current chemical injection systems.

The present invention provides concentrated chemicals without the need for a liquid carrier, so that the chemical in smaller quantities is more effective.

The chemical treatment assembly delivers chemical along the wellbore at the level of a hydrocarbon-bearing formation. The chemical treatment serves to inhibit the build-up of scale or other material along wellbore components during the production of reservoir fluids.

In one aspect, the assembly resides below a reciprocating pump within a wellbore.

In an embodiment of the downhole assembly, the invention is constructed from a blank tubular.

The chemical treating material can reside within the bore of the tubular body. In this instance, the chemical treating material can be in the form of a solid cylindrical "stick." The stick would represent one or more cylinders stacked within the downhole assembly. As reservoir fluids are produced from a subsurface formation, the fluids contact the "stick," causing the chemical treating material to slowly dissolve.

A method of treating a wellbore using a solid chemical is also provided herein. The chemical treatment is delivered along the wellbore at the level of a hydrocarbon-bearing formation, below a downhole pump. The chemical treatment serves to inhibit the build-up of scale or other selected contaminant along wellbore components during the production of reservoir fluids.

The invention includes a method for running a downhole assembly into a wellbore. The downhole assembly is designed in accordance with the downhole assembly described above in its various embodiments.

The method also includes threadably connecting the downhole assembly to a wellbore component. The wellbore component can be, for example, the lower end of a seating nipple. Alternatively, the wellbore component can be a joint of production tubing. The method can then include running the downhole assembly into the wellbore.

The method can then include producing hydrocarbon fluids from the wellbore.

DETAILED DESCRIPTION OF THE EMBODIMENTS

Before explaining the present assembly in detail, it is to be understood that the assembly is not limited to the particular embodiments and that it can be practiced or carried out in various ways.

For purposes of the present application, it will be understood that the term "hydrocarbon" can refer to an organic compound that includes primarily, if not exclusively, the elements hydrogen and carbon. Hydrocarbons can also include other elements, such as, but not limited to: halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" can refer to a hydrocarbon or mixtures of hydrocarbons that are gases or liquids. For example, hydrocarbon fluids can include a hydrocarbon or mixtures of hydrocarbons that are gases or liquids at formation conditions, at processing conditions or at ambient conditions (15 degrees Celsius and 1 atm pressure). Hydrocarbon fluids can include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" can refer to liquids and/or gases removed from a subsurface formation, including, for example, organic-rich rock formation, conventional sandstone or carbonate formation, or so-called unconventional shale or other low permeability formation. Produced fluids can include both hydrocarbon fluids and non-hydrocarbon fluids. Production fluids can include, but are not limited to: oil, natural gas, pyrolyzed shale oil, synthesis gas, a pyrolysis product of coal, carbon dioxide, hydrogen sulfide and water (including steam).

As used herein, the term "fluid" can refer to gases, liquids, and combinations of gases and liquids, as well as to combinations of gases and solids, combinations of liquids and solids, and combinations of gases, liquids, and solids. As used herein, the term "gas" can refer to a fluid that is in its vapor phase at about 1 atm and at 15 degrees Celsius.

As used herein, the term "oil" can refer to a hydrocarbon fluid containing primarily a mixture of condensable hydrocarbons.

As used herein, the term "subsurface" can refer to geologic strata occurring below the earth's surface.

As used herein, the term "formation" can refer to any definable subsurface region regardless of size. The formation can contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

The terms "zone" or "pay zone" or "zone of interest" can refer to a portion of a formation containing hydrocarbons. Alternatively, the formation can be primarily a water-bearing interval.

The term "production casing" can include a liner string or any other tubular body fixed in a wellbore along a zone of interest.

The term "hydrocarbon-bearing formation" can refer to a zone of interest or pay zone containing hydrocarbon fluids.

As used herein, the term "precipitate" can mean any substance precipitated from a wellbore fluid. Precipitates can include, for example, paraffin, waxes, scale, and iron sulfide.

As used herein, the term "wellbore" can refer to a hole in the subsurface made by drilling or insertion of a conduit into the subsurface. A wellbore can have a substantially circular cross-section, or other cross-sectional shapes. The term "well," when referring to an opening in the formation, can be used interchangeably with the term "wellbore."

Turning now to the Figures, FIG. 1 provides a side, cross-sectional view of a well site 100 constructed for hydrocarbon production. The well site 100 generally includes a wellbore 150 and a wellhead 20, which in the embodiment can be connected to a pump jack.

The wellbore 150 includes a bore 115 for receiving completion equipment and fluids. The bore 115 extends from a surface 101 of the earth, and down into the earth subsurface 110.

The wellbore 150 is first formed with a string of surface casing 120. The surface casing 120 has an upper end 122 in sealed connection with the wellhead 20. The surface casing 120 also has a lower end 124. The surface casing 120 can be secured in the wellbore 150 with a surrounding cement sheath 125. The cement sheath 125 resides in an annular region formed between the surface casing 120 and the surrounding earth subsurface 110.

The wellbore 150 also includes a lower string of casing 130. The lower string of casing 130 can also be secured in the wellbore 150 with a surrounding lower cement sheath 135. The lower string of casing 130 extends down to a bottom 104 of the wellbore 150. The lower string of casing 130 traverses a hydrocarbon-bearing formation 50. In one or more embodiments, the lower string of casing 130 can be referred to as production casing.

It is understood that the wellbore 150 can and likely will include at least one additional string of casing (not shown) residing between the surface casing 120 and the lower string of casing 130. These intermediate strings of casing can be hung from the surface. Alternatively, they can be hung from a next higher string of casing using a liner hanger. It is understood that the present inventions are not limited to the type of casing arrangement used.

The wellbore 150 also includes a string of production tubing 140. The production tubing 140 extends from a tubing hanger 30 at the wellhead 20, down proximate to the hydrocarbon-bearing formation 50. The production tubing 140 includes a bore 145 that transports production fluids from the hydrocarbon-bearing formation 50 up to the wellhead 20.

The wellbore 150 is further shown with a production packer 146. In one or more embodiments, the production packer is an option. The production packer 146 sits just above or proximate to the top of the hydrocarbon-bearing formation 50 and seals an annular area between the production tubing 140 and the surrounding lower string of casing 130. The production packer 146 keeps reservoir fluids from migrating behind the production tubing 140 during production.

The production tubing 140 connects to a pump 170. The pump 170 can be any type of pump used for lifting production fluids up to the surface 101. The pump 170 can be, for example, an electrical submersible pump, a jet pump, a gas lift, or a hydraulic pump. In this embodiment, the pump 170 is a positive displacement pump that is reciprocated using a string of sucker rods 160.

The sucker rods 160 represent slender joints of solid tubular that are typically 25 feet or 30 feet (7.62 or 9.14 meters) in length. The joints are connected end-to-end through threaded couplings 165. The sucker rods 160 extend from the surface 101 to the hydrocarbon-bearing formation 50 and support the pump 170.

In order to provide fluid communication between the hydrocarbon-bearing formation 50 and the production tubing 140, the lower string of casing 130, which can be production casing, has been perforated. A series of perforations 55 are shown.

As noted, the well site 100 also includes a wellhead 20. In the illustrative well site 100, the wellhead 20 can represent a pumping unit known as a "pump jack." The pump jack produces an up-and-down motion for reciprocating the string of sucker rods 160 and connected pump 170. The pump jack includes known components such as a walking beam 21, a horse head 22, and supporting Samson posts 23. The pump jack further includes a Pitman arm 24, a v-belt 25 and a prime mover 26 (an electric motor or an internal combustion engine) for turning the v-belt 25. The pump jack can also include a rotating counter-weight 27 that assists in providing mechanical advantage for reciprocating the horse head 22 and a connected bridle 28.

The wellhead 20 can also include a polished rod 31. The polished rod 31 connects the connected bridle 28 with the sucker rods 160. The polished rod 31 is received within a stuffing box 32. The pump jack, the polished rod 31, and the stuffing box 32 are all well-known components for producing hydrocarbons to the surface 101.

The wellhead 20 can also include various valves and flow lines for controlling the flow of production fluids at the surface. These can include a separate oil production line 36 and gas production line 37.

It is understood that the well site 100 arrangement of FIG. 1 is merely illustrative. In some instances, the hydrocarbon-bearing formation 50 will possess sufficient reservoir pressure to allow production fluids to be produced to the surface 101 without need of a pump 170, sucker rods 160, and the pumping unit. In that instance, a wellhead having a crown valve and/or master valves will be sufficient. Alternatively, a hydraulic pumping system can be employed that uses a hydraulic pump to cyclically pump fluid into a cylinder (not shown) above the wellbore 150. The fluid acts against a piston within the cylinder, causing the piston and the connected polished rod 31 and sucker rods 160 to reciprocate.

In any of these instances, it is oftentimes desirable to treat the wellbore components (such as the production tubing 140 and the pump 170) for scale or corrosion. Treating can mean preventing a build-up of scale or corrosion; alternatively, treating can mean reducing or removing scale that is present. The wellbore 150 of FIG. 1 contains a downhole chemical treatment assembly 180.

The downhole chemical treatment assembly 180, which can be a chemical delivery assembly, preferably resides below the pump 170 in an embodiment shown in FIG. 1, the downhole chemical treatment assembly 180 resides below and is connected to a seating nipple (not shown) below the pump 170. The downhole chemical treatment assembly 180 is designed to provide a solid chemical that slowly dissolves upon contact with hydrocarbon fluids such as brine. Beneficially, the downhole chemical treatment assembly 180 is disposed at or near the bottom 104 of the bore 115 so that treatment can be provided to downhole components and the entire production tubing 140.

Figure 2A:
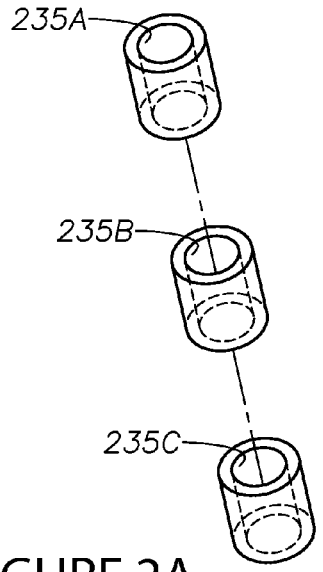
FIG. 2A is a perspective view of a plurality of donut shaped solid material usable as the chemical treating material of the downhole chemical treatment assembly according to the invention.

FIG. 2A is a perspective view of an embodiment of the downhole chemical treating material used in the assembly.

Here, the chemical treating material is in the form of a series of donut-shaped discs 235A, 235B, and 235C. Each disc has a bore. The discs are dimensioned to be contained within perforated tubing of the assembly. The discs can be stacked within the blank tubulars of the invention.

Figure 2C:
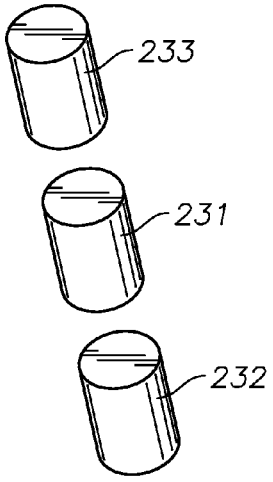
FIG. 2C is a perspective view of a plurality of sticks usable in a blank tubular as the chemical treating material.
Figure 2B:
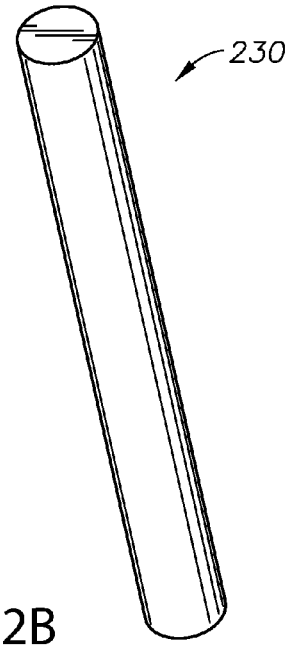
FIG. 2B is a perspective view of a cylindrical stick of the solid chemical treating material usable to completely fill the blank tubular of the invention.

FIG. 2B is a perspective view of a continuous solid material 230 that is usable as the chemical treating material of a downhole chemical treatment assembly.

Here, the chemical treating material is in the form of a solid "stick". The stick has a circular profile that generally conforms to the inner diameter of the blank tubular of the assembly. The stick can represent a single elongated cylinder that extends along the length of the assembly, or it can be a series of cylindrical bodies that are stacked.

The composition of the chemical treating material making up the discs or the sticks can be adjusted to provide treatment for different types of scale, corrosion, paraffin, or iron sulfide. In the case of scale, a corrosion inhibitor is employed in the solid chemical treating material. Corrosion inhibitors can be selected from the group consisting of: carboxylic acids and derivatives such as aliphatic fatty acid derivatives, imidazolines and derivatives; including amides, quaternary ammonium salts, amines, pyridine compounds, rosin derivatives, trithione compounds, heterocyclic sulfur compounds, quinoline compounds, salts, quats, polymers of any of these, and mixtures thereof. In addition, suitable inhibitors can include primary, secondary, and tertiary monoamines; diamines; amides; polyethoxylated amines, diamines or amides; salts of such materials; and amphoteric compounds. Other examples include imidazolines having both straight and branched alkyl chains, phosphate esters, and sulfur containing compounds.

The chemical delivery assemblies can be "tuned" to fit the needs of the operator. In this respect, the use of a longer tubing and surrounding screen allows for a larger amount of discs. This, in turn, may increase the life of the assembly, thereby delaying the need for the well to be taken off-line and the assembly to be pulled and reloaded. Of course, the amount of space available below the pump can determine the length of continuous solid material that can be deployed.

FIG. 2C provides an embodiment using a plurality of cylindrical chemical delivery sticks, each stick 231, 232 and 233 having different scale-inhibiting or corrosion inhibiting or other chemical treatment properties.

In one aspect, sticks can be formulated to treat primarily carbonate scales such as calcium carbonate or calcite [$CaCO_3$]. Sticks 231 can be formulated to treat primarily sulfate scales such as gypsum [$CaSO_42H_2O$] or anhydrite [$CaSO_4$] or calcium sulfate. Stick 232 can be formulated to primarily treat chloride scales such as sodium chloride [NaCl] or, alternatively, iron scales such as iron sulfide [FeS] or iron oxide [$Fe_2O_3$]. Any of these sticks can include the following known scale-inhibiting agents: phosphates, phosphate esters, phosphoric acid, phosphonates, phosphonic acid, polyacrylamides, salts of acrylamido-methyl propane sulfonate/acrylic acid copolymers (AMPS/AA), phosphinated maleic copolymers (PHOS/MA), salts of a polymaleic acid/acrylic acid/acrylamido-methyl propane sulfonate terpolymer (PMA/AMPS), sulfamic acids, or mixtures thereof.

By stacking all three sticks, different types of inhibitors can be employed simultaneously in the same wellbore. The sticks can all contain a mixture of the different treatments.

For example stick 231 can contain corrosion treatment and chloride treatment, stick 233 can contain different treatments plus corrosion treatment, and stick 232 can contain all the components, with different weight percentages.

It is also noted that the discs and sticks can be used to treat well conditions other than scale build-up. For example, the solid chemical material, or "stick," can be placed within a downhole chemical treatment assembly to prevent wax build-up. This requires the placement of a paraffin inhibitor within the chemical "stick."

Paraffin inhibitors are used in petroleum production operations to reduce wax deposition along wellbore equipment and flow lines. The active chemistries of paraffin inhibitor products are specialty polymers that alter the wax crystallization process. This, in turn, changes the characteristics of wax deposits. The paraffin inhibitor can be, for example, a blend of surfactants with aromatic solvents. The surfactants can be either nonionic or anionic surfactants.

The discs and sticks can also be used to prevent the growth of bacteria. In this embodiment the chemical "stick" can include a solid and dissolvable biocide to prevent growth of bacteria. The biocide, or bactericide, can be selected from the group consisting of, for example: formaldehyde, paraformaldehyde, glutaraldehyde, ammonia, quaternary ammonium compounds, sodium hypochlorite, phenols, and mixtures thereof.

In another embodiment, the continuous solid chemical material can also have a solid and dissolvable asphaltene inhibitor. Suitable asphaltene treatment chemicals can include those such as alkylphenol ethoxylates and aliphatic polyethers.

Any of the above conditions can be treated by placing a suitably designed continuous solid material in the form of discs or sticks in the chemical delivery assemblies.

Other arrangements for a downhole chemical treatment assembly can be provided.

Figure 3:
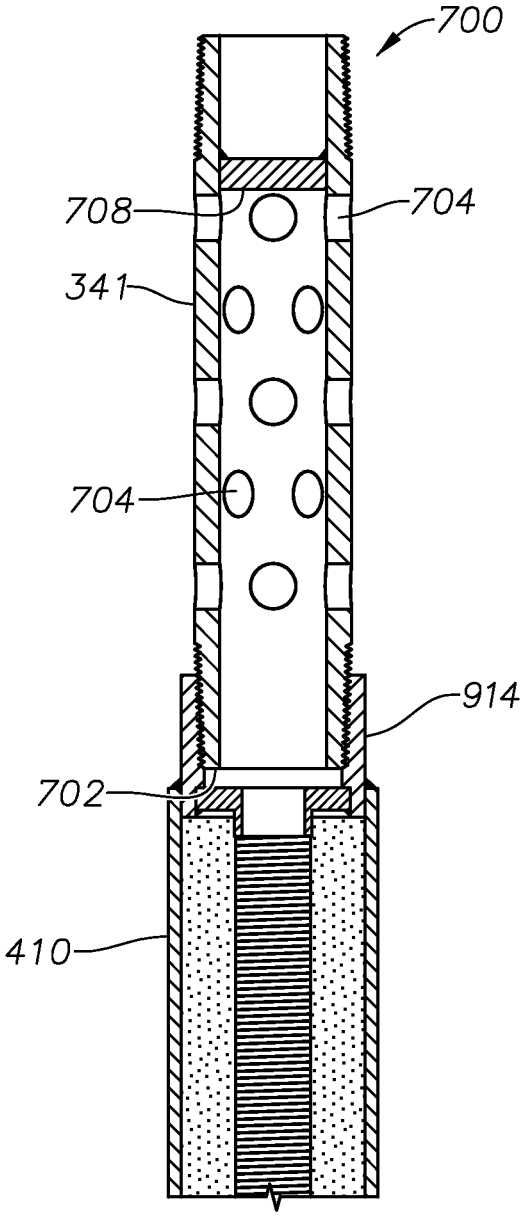
FIG. 3 is a side, cross-sectional view of an end piece usable with the downhole chemical treatment assembly.

FIG. 3 is a side view of an end piece usable with the downhole chemical treatment assembly for treating wellbore components of the present invention, in an alternate embodiment.

Figure 4A:
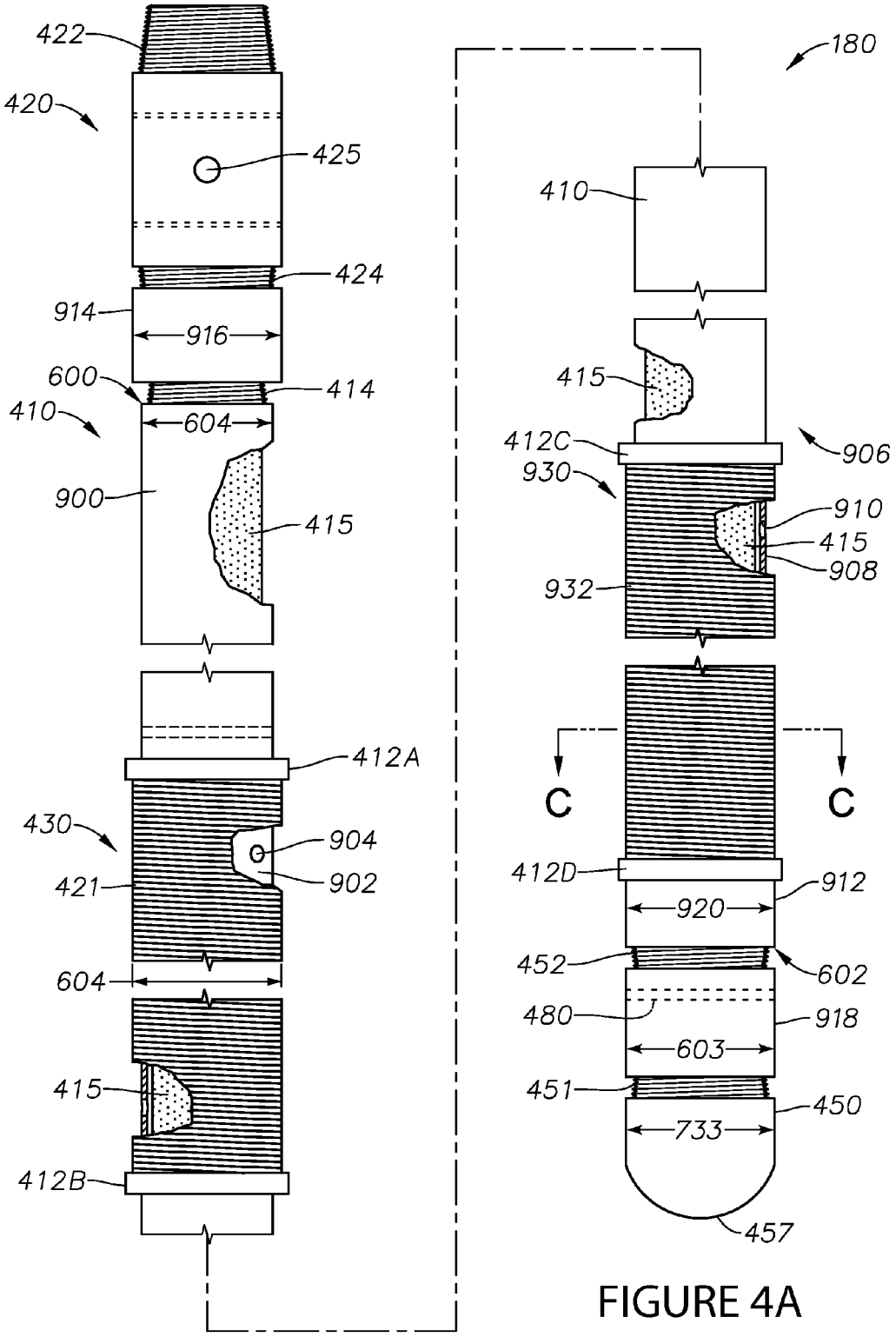
FIG. 4A provides a side view of a downhole chemical treatment assembly.

An end piece 700 in embodiments replaces the no-flow nipple to engage an upper collar 914 of the assembly as shown in FIG. 4A.

The end piece 700 has an intake end 702, a plurality of through ports 704 formed in a wall 341 of the end piece 700 allowing fluid to flow into a blank tubular 410.

The end piece 700 has a plug end 708 for preventing fluid from entering the blank tubular 410.

The end piece 700 has a first orientation for flowing fluid into the blank tubular 410, and a second orientation for preventing fluid from entering the blank tubular 410. The second orientation is 180 degrees from the first orientation, essentially the reverse of the first orientation.

Figure 4B:
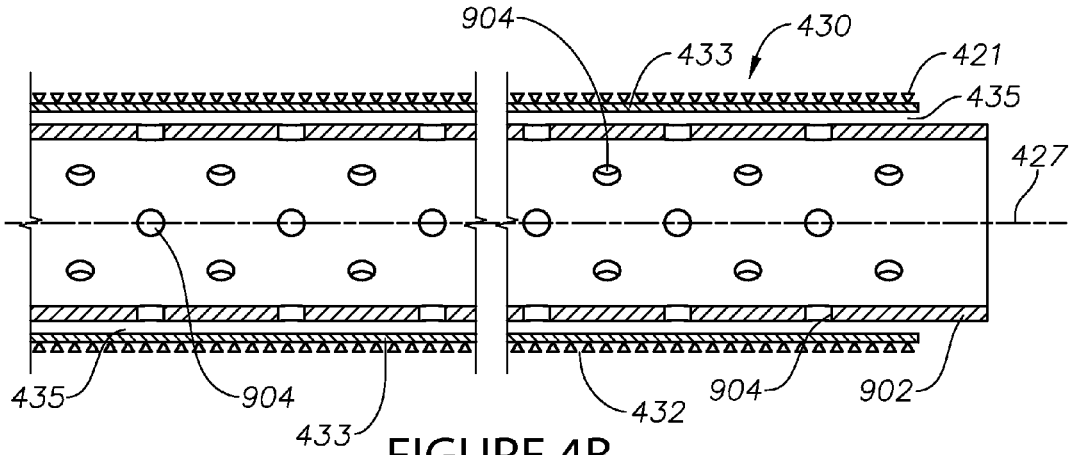
FIG. 4B is a side view of the second perforated section of the downhole chemical treatment assembly of FIG. 4A.
Figure 4C:
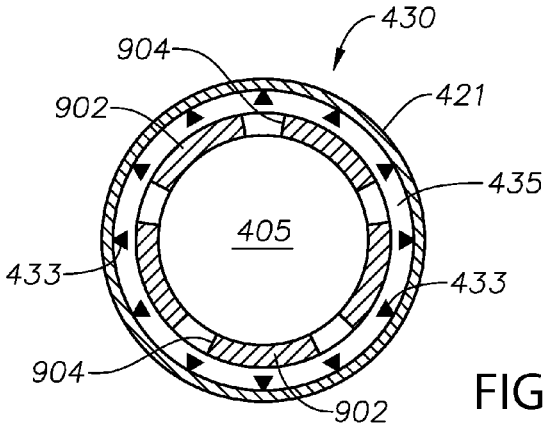
FIG. 4C is a cross sectional view cut across line C-C of FIG. 4A.

FIGS. 4A, 4B and 4C depict the downhole chemical treatment assembly 180.

The downhole chemical treatment assembly 180 includes the blank tubular 410. The blank tubular 410 can be a single joint of tubing that is about 23.5 feet (7.16 meters) in length. Such tubing can have an inner diameter of, for example, 2⅜", 2½", or 2/7/8" and as large as 4 inches. The blank tubular 410 can have at least one perforated tubing sections.

The overall blank tubular can be pre-loaded prior to insertion in the wellbore with 23 and ½ feet of one foot solid chemical sticks.

FIGS. 4A, 4B and 4C describe a downhole chemical treatment assembly 180 for use in a downhole wellbore for hydrocarbon fluid.

The three Figures depict a blank tubular 410 having a first end 600, a second end 602, a central axis 427 and an outer diameter 604.

In one or more embodiments, the blank tubular can be from 8 feet to 24 feet in length. In one or more embodiments, two connected blank tubulars can be 48 feet in length.

The blank tubular can be a plurality of sequentially connected sections. That is, the blank tubular can be a one piece integral tubular that has been machined or formed into sections.

The blank tubular 410 has an upper blank tubing section 900 without any holes, a solid wall forming the tubular and a central opening.

The upper blank tubing section 900 is about 3 feet to 4 feet (0.91 meters to 1.22 meters) in length. This length is sufficient to allow a pipe pick-up machine to handle the assembly at a well site. In embodiments, the upper blank tubing section can have a length from 1 foot to 6 feet.

In embodiments the outer diameter of the upper blank tubing section can be coated to reduce corrosion with a nickel plating 0.0022 inches to 0.004 inches in thickness.

In embodiments of the downhole chemical treatment assembly, the upper blank tubing section can be connected to a first perforated section 902 containing a chemical treating material contained in the blank tubular 410, which has a length ranging from 1 foot, 10 feet, or 20 feet (0.31, 3.05 or 6.1 meter) in cylindrical body.

The upper blank tubing section is adapted in embodiments to have a threaded end to join with another component termed "a no-flow nipple" or a "standard nipple", or a "chemical retention nipple" or in embodiments, an end piece which has been described herein.

The term "no-flow nipple" as used herein can refer to a nipple without an opening that blocks fluid flow.

The "standard nipple" as used herein can refer to a connection that acts to connect two pieces of tubing together with a central flow path.

The term "chemical retention nipple" as used herein can refer to a nipple that allows fluid flow but restricts chemicals from falling out of tubing into the ground or other apparatus.

In embodiments, the nipples and end piece are removably securable to the blank tubular to enable repair and versatility of the assembly for various sizes of pipe and use in many different tubing strings and downhole equipment.

The upper blank tubing section 900 can connect to a first perforated section 902 with a plurality of first perforations, such as first perforation 904.

From 4 to 12 first perforations can be formed in the first perforated section. Each first perforation can be in the shape of a circle, an elliptical or can have another shape. Each first perforation can have a diameter from 0.25 inches to 0.75 inches. The edges of the first perforations, in an embodiment, can be beveled to allow for easier flow of fluid through the first perforations.

The length of the first perforated section can be from 6 inches to 24 inches.

In the embodiment of FIGS. 4A, 4B, and 4C, the blank tubular is an integral, one-piece pipe having sections formed in the pipe.

In another embodiment, the assembly can be formed from individual sections of pipe or tubular that are welded together, or otherwise connected together in series. Starting with the upper blank tubing section 900.

In embodiments, the outer diameters of the sections are identical, such as having outer diameters from 2 inches to 4.5 inches.

In embodiments, the inner diameters of the sections are identical, such as having an inner diameter from 1 inch to 4 inches.

In embodiments, the outer diameter of the tubular can be wider in the blank sections than the perforated sections by 10 percent.

In embodiments, the walls of the tubular can be identical in thickness for each section.

A thickness of the walls of the upper blank tubular can be from ⅛ inches to ¼ inches.

The blank tubular 410 can have a middle blank tubing section 906 formed adjacent the first perforated section 902. The middle blank tubing section can be from 12 feet to 24 feet in length. For some embodiments, the middle blank section of the overall assembly can be 8 feet in length, and the middle blank section can be from 4 feet and 6 feet.

In embodiments the assembly is a one piece integral tubular made from J-55 steel. However, in other embodiments, different sections of the assembly can be formed from different materials, such as the upper blank tubular can be formed form steel, but the perforated section can be formed from a different material steel like L-80 or N-80 steel to create a stronger device.

The blank tubular 410 has a second perforated section 908 formed in series with the middle blank tubing section 906. The second perforated section 908 has a plurality of second perforations 910, with 200 percent to 2000 percent more second perforations formed in this second perforated section than formed first perforations in the first perforated section.

In an embodiment, from 40 to 100 second perforations can be formed in the second perforated section with the diameter being ¼ inch to ⅜ inch.

The shape of the perforations can differ in the second perforated section from the first perforated section.

In an embodiment, the perforations are uniformly dispersed over all portions of the first and second perforated sections.

In an embodiment, the perforations are grouped in sections of the perforated sections to orient more accurately with the flow of the hydrocarbon fluid.

In another embodiment, in the first perforated section, the first perforations can be aligned in a row.

In embodiments, the second perforated section can be from 2 feet to 6 feet in length.

The blank tubular 410 has a lower blank tubing section 912 formed adjacent the second perforated section 908. The lower blank tubing section can be from 6 inches to 24 inches in length.

The upper collar 914 can be formed and secured around the first end 600 with an upper collar outer diameter 916. The upper collar outer diameter can range from 2 inches to 5 inches. The upper collar can be made from steel. The upper collar can have a length from 3 inches to 8 inches.

A lower collar 918 can be secured around the second end 602. The lower collar 918 has a lower collar diameter 920.

Each collar can have an outer diameter larger than the blank tubular outer diameter 604 by at least 2 percent and up to 25 percent.

The lower collar 918 can have a different outer diameter from the upper collar or be identical to the upper collar. The lower collar, in embodiments, can be made from the same material as the upper collar 914 or can be a different material to reduce weight of the overall assembly. The lower collar can have an identical length to the upper collar or be slightly more or less, depending on customer specifications.

Inserted and filling the inner diameter of the blank tubular and all the sections is a dissolving solid chemical treating material 415. In one or more embodiments, the dissolving solid chemical treating material can be pellets with an average diameter from 0.030 inches to 0.100 inches in diameter.

This dissolving solid chemical treating material 415 can take a variety of forms, such as sticks, discs, solid cylinders, and even pellets, as mentioned earlier. The material can be combinations of different chemicals, depending on the condition needing treatment in the wellbore.

In all embodiments, the dissolving solid chemical treating material 415 fills at least 80 percent and up to 100 percent of the inner bore of the blank tubular.

The dissolving solid chemical treating material treats carbonate scale buildup; chloride scale buildup; iron scale buildup; paraffin buildup; corrosion; asphaltene buildup; and combinations thereof as already mentioned.

A special feature of the embodiments is a first tubular filtering screen 430 encircling the first perforated section 902.

The first tubular filtering screen 430 is constructed from helically wrapped wire around a plurality of longitudinally oriented first ribs 433 disposed around the central axis 427 of the blank tubular.

The helically wrapped wire is a continuous wrapped first wire 421 wound around the longitudinally oriented first ribs forming a plurality of first slots 432 between the portions of continuous wrapped first wire.

The first slots 432 are dimensioned to control a rate of dissolution of the solid chemical treating material though the first slots while forming from a first annulus 435 between the continuous wrapped first wire 421 and the first perforated section 902.

The continuous wrapped first wire 421 can have a thickness from 0.060 inches to 0.090 inches. In embodiments the continuous wrapped first wire is wrapped at a density from 5 to 15 wraps per inch. In embodiments, the continuous wrapped first wire can be a v-profile wire, a flat wire or a rounded wire.

In embodiments the continuous wrapped first wire can be made from stainless steel such as 304 or 316 stainless steel or MONEL™ metal or aluminum or other steel alloys.

In embodiments, the first tubular filtering screen can be formed to cover all the perforations of each perforated section.

Each first rib can be formed from steel or the same material as the continuous wrapped first wire. In an embodiment, each first rib can have a thickness from 0.060 inches to 0.090 inches and a length substantially equivalent to the length of the perforated sections. Each first rib connects each loop of the continuous wrapped first wire, cutting across the continuous wrapped first wire at an angle from 80 degrees to 110 degrees, fully supporting each strand of the continuous wrapped first wire.

In an embodiment, the first tubular filtering screen can be formed from two or more continuous wire wrapped screens assembled together.

A second tubular filtering screen 930 encircles around the second perforated section 908. In embodiments, the second tubular filtering screen can be a one-piece construction and the first tubular filtering screen can be a plurality of connected screens.

The second tubular filtering screen, like the first tubular filtering screen, can have a plurality of longitudinally oriented second ribs identical to the first ribs and disposed around the central axis 427, such as from 10 to 40 ribs.

The second tubular filtering screen can have a continuous wrapped second wire 932 wound around the longitudinally oriented second ribs forming a plurality of second slots allowing fluid to pass through the slots to the chemical treating material like the first slots.

The slots are dimensioned to control a rate of dissolution of the solid chemical treating material through the slots while forming form a second annulus identical to the first annulus between the continuous wrapped second wire and the second perforated section.

In an embodiment, the wire can present a "v" shaped profile as shown in FIG. 4B.

A plurality of weld rings can be attached to the blank tubular. Each weld ring 412A, 412B, 412C, and 412D supports an end of one of the tubular filtering screens to hold the tubular filtering screens over the perforated sections securely.

In embodiments, the weld rings have an outer diameter from 10 percent to 20 percent greater than the blank tubular, such as 3 inches to 5 inches. Each weld ring can be made from steel. Each weld ring can have a thickness from ¼ inch to 1 inch.

In embodiments, the weld rings are welded to the blank tubular outer diameter.

A no-flow nipple 420 is secured to the upper collar 914 to seal the downhole chemical treatment assembly. In FIG. 4A, the no-flow nipple is secured to the upper collar in a removable fashion via a threaded engagement.

A bull plug 450 is secured to the lower collar 918 to seal the downhole chemical treatment assembly. The bull plug can have a rounded nose 457 for easier insertion of the assembly into the wellbore.

The bull plug can have bull plug threads 451 to provide a removable threaded engagement with the blank tubular, allowing for replacement if the bull plug gets damaged.

In embodiments, the bull plug has an outer diameter identical to the blank tubular. In embodiments, the bull plug nose can be tapered.

The downhole chemical treatment assembly provides a dissolution rate from about 10 ppm to about 400 ppm into the hydrocarbon fluid when inserted into the wellbore.

In embodiments, the downhole chemical treatment assembly is for use in a downhole wellbore and connects to a member of the group: tubing to be run into the wellbore; a bottom hole assembly for running into a wellbore; a wireline for running into a wellbore; a sand screen filter intake for use in a wellbore; a gas separator for use in a wellbore; a perforated lifting sub; or a seating nipple for use in a wellbore.

In embodiments, the downhole chemical treatment assembly has a sealing disc 480 positioned inside the lower collar providing a redundant seal with the bull plug. The sealing disc can be made of steel, plastic, nylon, TEFLON™ or stainless steel. The thickness of the sealing disc can be from ¼ inch to ¾ inch.

In embodiments, the downhole chemical treatment assembly has first threads 414 on the upper blank tubing section 900 for connecting the upper collar to the blank tubular.

In embodiments of the downhole chemical treatment assembly, the no-flow nipple 420 has top threads 424 for engaging the no-flow nipple with the upper collar.

In embodiments, the downhole chemical treatment assembly has second threads 452 on the lower blank tubing section 912 for engaging the lower collar to the blank tubular.

In embodiments, the downhole chemical treatment assembly has bull plug threads 451 for engaging the lower collar with the bull plug 450.

In embodiments of the downhole chemical treatment assembly, the lower collar is welded to the outer diameter of the blank tubular 410.

In embodiments of the downhole chemical treatment assembly, the bull plug has a bull plug outer diameter 733 identical to a lower collar outer diameter 603.

In embodiments of the downhole chemical treatment assembly, the continuous wrapped first and second wires are welded to the longitudinally oriented first and second ribs.

The no-flow nipple 420 has no-flow nipple upper threads 422 to secure the no-flow nipple to oil field equipment for receiving production fluids from the wellbore.

The no-flow nipple 420 can be solid between the threads for preventing fluid flowing into or out of the blank tubular. In embodiments, the no-flow nipple can have a through-opening 425 providing an indicator that the no-flow nipple acts as a plug.

Figure 5:
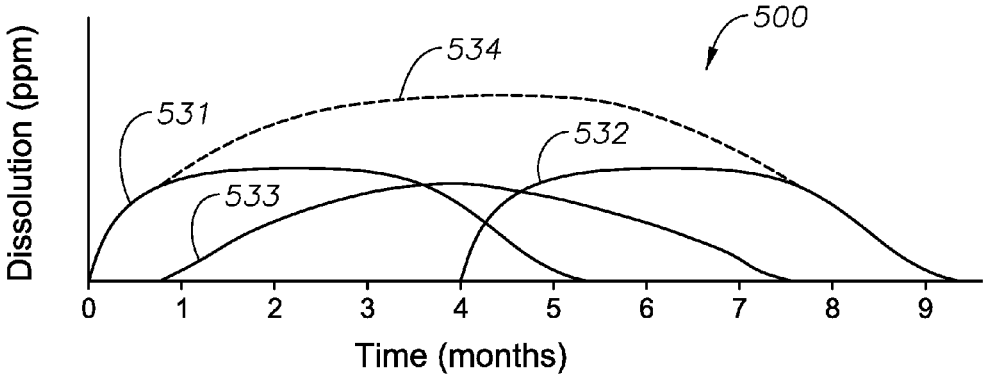
FIG. 5 provides a graph showing dissolution (in parts per million) using the invention.

FIG. 5 provides a graph depicts as a Cartesian coordinate 500. Time (in months) is shown on the "x"-axis, while dissolution (in parts per million) is plotted along the "y"-axis. Line 531 presents an illustrative dissolution rate for chemical stick 231; line 532 presents an illustrative dissolution rate for chemical stick 232; and line 533 presents an illustrative dissolution rate for chemical stick 233 of FIG. 2C. Dissolution rates can be, for example, between about 25 ppm and 150 ppm.

In FIG. 5, a fourth line is shown at 534. The fourth line 534 is dashed, and represents a sum of the values (dissolution rates) for lines 531, 532 and 533. Line 534 demonstrates a smoothing effect from having three different chemical sticks 231, 232, 233 having different dissolution rates.

In FIG. 5, lines 531 and 532 suggest an effective life of about 5 months for the first chemical stick 231 and the second chemical stick 232, while line 533 suggest an effective life of about 6 months for a third chemical stick 233. It is understood that these life spans are merely illustrative, and that ideally a life span of 8 to 12 months would be provided.

As an alternative to adjusting screen slot sizes or adjusting the dissolution rate of a solid chemical treating material or using a membrane, a downhole chemical treatment assembly may have an inflow control device. In one aspect, the inflow control device is electrically powered, and borrows power from a power cord associated with an electrical submersible pump, or ESP.

Figure 6A:
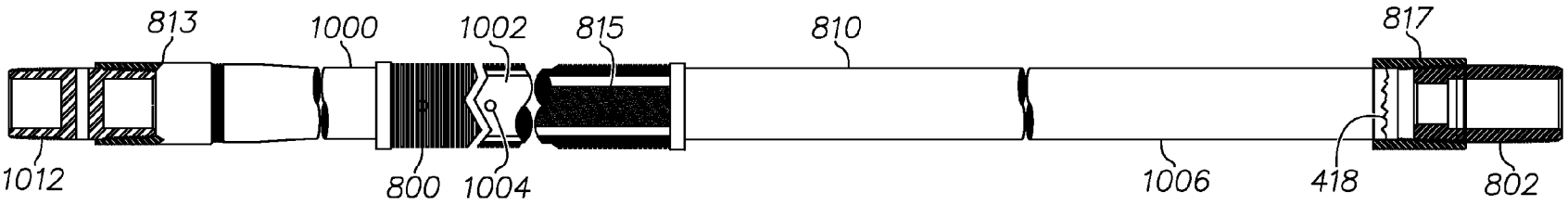
FIG. 6A shows a side view of a second blank tubulars which can be connected to the first blank tubular shown in FIG. 4A for delivery of the dissolving chemical according to the invention.
Figure 6C:
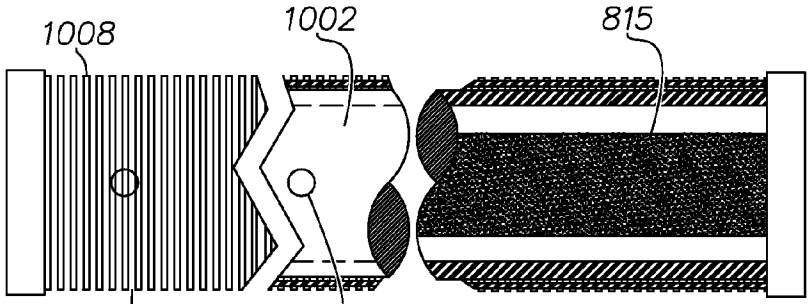
FIG. 6C is a detailed side view of the perforated section of FIG. 6A.
Figure 6B:
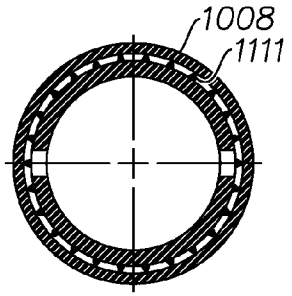
FIG. 6B is a cross section view of the second blank tubular perforated section shown in FIG. 6A.

FIGS. 6A, 6B and 6C show a membrane 418 disposed between a second blank tubular 810 and the first blank tubular 410 shown in FIG. 4A.

The membrane 418 slowly dissolves over a period of days, allowing a timed access to dissolving solid chemical treating material 815. The dissolving solid chemical treating material dissolves upon contact with a hydrocarbon fluid adapted to dissolve a member selected from the group: carbonate scale buildup; chloride scale buildup; iron scale buildup; paraffin buildup; corrosion; asphaltene buildup; and combinations thereof.

FIGS. 6A-6C also show the second blank tubular 810 with a chemical retention nipple 802 that permits fluid flow and prevents the chemical from exiting the tubing during installation.

The second blank tubular 810 connects to the first blank tubular without using the no-flow nipple of the first blank tubular, and forms an extended assembly of two connected blank tubulars.

The second blank tubular further has a second blank tubular upper blank tubing section 1000; a second blank tubular perforated section 1002 with a plurality of second blank tubular perforations 1004.

The second blank tubular also has a second blank tubular lower blank tubing section 1006 adjacent the second blank tubular perforated section 1002.

The second blank tubular has a second blank tubular upper collar 813 secured around a first end of the second blank tubular; and a second blank tubular lower collar 817 secured around a second end of the second blank tubular. Each collar has an outer diameter slightly larger than the outer diameter of the second blank tubular.

Inside the second blank tubular is installed the dissolving solid chemical treating material 815 filling the second blank tubular. A second blank tubular filtering screen 800 encircles the second blank tubular perforated section 1002.

The second blank tubular filtering screen 800 has a plurality of longitudinally oriented second blank tubular ribs 1111 and a second blank tubular continuous wrapped wire 1008 wound around the second blank tubular longitudinally oriented second blank tubular ribs 1111 forming a plurality of second blank tubular slots 1010 between the second blank tubular continuous wrapped wire.

The slots are dimensioned to control a rate of dissolution of the dissolving solid chemical treating material though the slots while forming an annulus between the second blank tubular continuous wrapped wire and the second blank tubular perforated section.

A second blank tubular no-flow nipple 1012 connects to the second blank tubular upper collar 813. The second blank tubular no-flow nipple 1012 seals off the second blank tubular and connects to oil field equipment for receiving production fluids from the wellbore.

While these embodiments have been described with emphasis on the embodiments, it should be understood that within the scope of the appended claims, the embodiments might be practiced other than as specifically described herein.

What is claimed is:

1. A downhole chemical treatment assembly for use in a downhole wellbore for hydrocarbon fluid, comprising:

a. a blank tubular having a first end, a second end, a central axis and an outer diameter, and wherein the blank tubular consists of:
   (i) an upper blank tubing section;
   (ii) a first perforated section with a plurality of first perforations in series with the upper blank tubing section;
   (iii) a middle blank tubing section formed adjacent the first perforated section;
   (iv) a second perforated section formed in series with the middle blank tubing section having a plurality of second perforations, wherein 200 percent to 2000 percent more second perforations are formed than first perforations; and
   (v) a lower blank tubing section formed adjacent the second perforated section;

b. an upper collar secured around the first end with an upper collar outer diameter;

c. a lower collar secured around the second end with a lower collar diameter, and each collar has an outer diameter larger than the blank tubular outer diameter;

d. a dissolving solid chemical treating material filling the blank tubular from the upper blank tubing section to the lower blank tubing section, comprising a chemical adapted to dissolve upon contact with a hydrocarbon fluid from the downhole wellbore and treat a member of the group comprising:
   (i) carbonate scale buildup;
   (ii) chloride scale buildup;
   (iii) iron scale buildup;
   (iv) paraffin buildup;
   (v) corrosion;
   (vi) asphaltene buildup; and
   (vii) combinations thereof;

e. a first tubular filtering screen encircling the first perforated section, wherein the first tubular filtering screen comprises:
   (i) a plurality of longitudinally oriented first ribs disposed around the central axis; and
   (ii) a continuous wrapped first wire wound around the longitudinally oriented first ribs forming a plurality of first slots between the continuous wrapped first wire, and the first slots are dimensioned to control a rate of dissolution of the dissolving solid chemical treating material though the first slots while forming a first annulus between the continuous wrapped first wire and the first perforated section;

f. a second tubular filtering screen encircling the second perforated section, the second tubular filtering screen comprising:
   (i) a plurality of longitudinally oriented second ribs and disposed around the central axis; and
   (ii) a continuous wrapped second wire wound around the longitudinally oriented second ribs forming a plurality of second slots, and the second slots are dimensioned to control a rate of dissolution of the dissolving solid chemical treating material through the second slots while forming a second annulus between the continuous wrapped second wire and the second perforated section;

g. a plurality of weld rings, wherein each weld ring secures an end of one of the tubular filtering screens;

h. a no-flow nipple secured to the upper collar to seal the downhole chemical treatment assembly; and i. a bull plug secured to the lower collar to seal the downhole chemical treatment assembly, and the downhole chemical treatment assembly provides a dissolution rate from 10 ppm to 180 ppm into the hydrocarbon fluid when inserted in the wellbore.

2. The assembly of claim 1, wherein the downhole chemical treatment assembly is for use in the downhole wellbore and connects to a member of the group:

a. tubing to be run into the wellbore;

b. a bottom hole assembly for running into a wellbore;

c. a wireline for running into a wellbore;

d. a sand screen filter intake for use in a wellbore;

e. a gas separator for use in a wellbore;

f. a perforated lifting sub; or g. a seating nipple for use in a wellbore.

3. The assembly of claim 1, comprising a sealing disc positioned inside the lower collar providing a redundant seal with the bull plug.

4. The assembly of claim 1, further comprising first threads on the upper blank tubing section for connecting the upper collar to the blank tubular.

5. The assembly of claim 1, further comprising bottom threads on the no-flow nipple for engaging the no-flow nipple with the upper collar.

6. The assembly of claim 1, further comprising second threads on the lower blank tubing section for engaging the lower collar to the blank tubular.

7. The assembly of claim 1, further comprising bull plug threads for engaging the lower collar with the bull plug.

8. The assembly of claim 1, wherein the lower collar is welded to the outer diameter of the blank tubular.

9. The assembly of claim 1, wherein the dissolving solid chemical treating material comprises a plurality of segments contained in the blank tubular, the segments comprising a member of the group:

a. pellets;

b. discs, comprising holes or solid centers; and c. a plurality of solid cylindrical sticks.

10. The assembly of claim 1, wherein the bull plug has a bull plug outer diameter identical to a lower collar outer diameter.

11. The assembly of claim 1, wherein the continuous wrapped first wire and the continuous wrapped second wire are welded to the longitudinally oriented first ribs and the longitudinally oriented second ribs.

12. The assembly of claim 1, further comprising a membrane disposed between a third tubular filtering screen and a third perforated section in a second blank tubular with the membrane for slowly dissolving over a period of days, allowing a timed access to the dissolving solid chemical treating material, wherein the dissolving solid chemical treating material dissolves upon contact with a hydrocarbon fluid adapted to dissolve a member selected from the group:

a. carbonate scale buildup;

b. chloride scale buildup;

c. iron scale buildup;

d. paraffin buildup;

e. corrosion;

f. asphaltene buildup; and g. combinations thereof.

13. The assembly of claim 12, wherein the second blank tubular has a retention nipple that permits fluid flow, and prevents the chemical from exiting the tubing during installation, the second blank tubular connects to the first blank tubular without using the no-flow nipple of the first blank tubular, and forming an extended assembly of two connected blank tubulars, the second blank tubular comprising:

a. a second blank tubular upper blank tubing section;

b. a second blank tubular perforated section with a plurality of second blank tubular perforations;

c. a second blank tubular lower blank tubing section adjacent the second blank tubular perforated section;

d. a second blank tubular upper collar secured around a first end of the second blank tubular;

e. a second blank tubular lower collar secured around a second end of the second blank tubular with each collar having an outer diameter slightly larger than the outer diameter of the second blank tubular;

f. a dissolving solid chemical treating material filling the second blank tubular;

g. a second blank tubular filtering screen encircling the second blank tubular perforated section, the second blank tubular filtering screen comprising:

(i) a plurality of longitudinally oriented second blank tubular ribs; and (ii) a second blank tubular continuous wrapped wire wound around the longitudinally oriented second blank tubular ribs forming a plurality of second blank tubular slots between the second blank tubular continuous wrapped wire, the slots dimensioned to control a rate of dissolution of the solid chemical treating material though the slots while forming an annulus between the second blank tubular continuous wrapped wire and the second blank tubular perforated section;

h. a second blank tubular no-flow nipple connected to the second blank tubular upper collar, the second blank tubular no-flow nipple seals off the assembly and connects to oil field equipment for receiving production fluids from the wellbore.

14. The assembly of claim 1, wherein the no-flow nipple further comprises a through-opening providing an indicator that the no-flow nipple acts as a plug.

15. The assembly of claim 1, further comprising an end piece that replaces the no-flow nipple to engage the upper collar, the end piece comprises an intake end, a plurality of through ports formed in a wall of the end piece the through ports and the intake end allowing fluid to flow into the blank tubular, the end piece also has a plug end for preventing fluid entering the blank tubular, and the end piece has a first orientation for engaging the blank tubular for flowing fluid into the blank tubular, and a second orientation engaging the blank tubular for preventing fluid from entering the blank tubular.

16. The assembly of claim 1, further comprising slots with widths from 0.006 inches to 0.075 inches to control a rate of dispersion of the dissolving solid chemical treating material.

17. The assembly of claim 1, further comprising perforated tubing sections have lengths from 1 foot to 10 feet.

18. The assembly of claim 1, further comprising a dissolving solid chemical treating material that inhibits bacteria growth.

19. The assembly of claim 1, further comprising no-flow nipple upper threads formed on the no-flow nipple to secure the no-flow nipple to oil field equipment for receiving production fluids from the wellbore.

20. The assembly of claim 19, wherein the no-flow nipple is solid between the threads for preventing fluid flowing into or out of the blank tubular.

* * * * *